US009821990B2

(12) United States Patent
Zanichelli

(10) Patent No.: US 9,821,990 B2
(45) Date of Patent: Nov. 21, 2017

(54) ELECTRIC LIFTER

(71) Applicant: Zapi S.P.A., Poviglio (IT)

(72) Inventor: Giannino Zanichelli, Poviglio (IT)

(73) Assignee: Zapi S.P.A., Poviglio (IT)

( * ) Notice: Subject to any disclaimer, the term of this patent is extended or adjusted under 35 U.S.C. 154(b) by 81 days.

(21) Appl. No.: 14/159,126

(22) Filed: Jan. 20, 2014

(65) Prior Publication Data

US 2014/0231176 A1 Aug. 21, 2014

(30) Foreign Application Priority Data

Feb. 15, 2013 (EP) ..... 13 155 442

(51) Int. Cl.
*B66F 9/08* (2006.01)
*B66F 9/07* (2006.01)
*B66F 9/24* (2006.01)

(52) U.S. Cl.
CPC ..... *B66F 9/08* (2013.01); *B66F 9/07* (2013.01); *B66F 9/24* (2013.01)

(58) Field of Classification Search
CPC ..... B66F 9/08; B66F 9/07; B66F 9/24
USPC ..... 187/236
See application file for complete search history.

(56) References Cited

U.S. PATENT DOCUMENTS

| | | | | | |
|---|---|---|---|---|---|
| 2,643,740 | A * | 6/1953 | Quayle | 187/231 |
| 2,664,970 | A * | 1/1954 | Warshaw | 187/226 |
| 3,612,221 | A * | 10/1971 | Branham | 187/222 |
| 3,782,503 | A * | 1/1974 | Sinclair | 187/226 |
| 4,024,972 | A * | 5/1977 | Hobson | 414/607 |
| 4,485,894 | A | 12/1984 | Soule | |
| 5,657,834 | A * | 8/1997 | Plaugher et al. | 187/226 |
| 7,730,981 | B2 * | 6/2010 | McCabe et al. | 180/65.225 |
| 8,869,944 | B2 * | 10/2014 | McCabe et al. | 187/226 |
| 2008/0128214 | A1 * | 6/2008 | Tahashi et al. | 187/224 |
| 2008/0290842 | A1 * | 11/2008 | Davis et al. | 320/166 |

FOREIGN PATENT DOCUMENTS

| | | | |
|---|---|---|---|
| DE | 3041821 | A1 | 5/1982 |
| DE | 10130246 | A1 | 1/2003 |
| DE | 102004019914 | A1 | 11/2005 |
| EP | 0443955 | A1 | 8/1991 |
| EP | 2116504 | A1 | 11/2009 |
| WO | 2012146956 | A1 | 11/2012 |

* cited by examiner

*Primary Examiner* — Michael Riegelman
(74) *Attorney, Agent, or Firm* — Moore & Van Allen PLLC; Henry B. Ward, III

(57) ABSTRACT

The invention provides an electric lifter, comprising a fixed mast structure, a movable mast structure that is movable relative to the fixed mast structure at feast one transmission means (chain or cog drive belt or rack or similar), and a load carrier, in particular a fork load carrier, being connected to the at least one transmission means and configured to carry a load, wherein the at least one transmission means is movably connected to the movable mast structure while being configured to move along a closed loop path, the closed loop path being stationary relative to the movable mast structure.

15 Claims, 13 Drawing Sheets

SECTION A-A REF. FIG. 12

SECTION B-B REF. FIG. 12

ELECTRIC LIFTER

FIELD OF THE INVENTION

The present invention relates to the multitude of machines utilized to lift up loads, goods such as, without limitations, lifters or, for example, fork-lift trucks.

BACKGROUND OF THE INVENTION

The forklift is a basic tool of today's industry, but not only: warehouses, distribution centres, manufacturing plants, factories, and many other commercial and agricultural applications depend on forklifts utilization to keep the daily work running easily. Forklifts are named for the L-shaped "forks" typically used to handle and to lift pallets, but the trucks can be outfitted with different accessories for picking up spools, drums, or other specific loads as well. These trucks, also called "lift trucks", are available for both indoor and outdoor applications.

A lift truck is typically designed and includes the components as follows. The whole truck is a motive machine with wheels powered through a transmission and drive train. An engine is provided, for example a diesel or a gas powered internal combustion engine, or a battery-powered electric motor. A counter balance is attached to the rear of the machine, which is a heavy iron mass, necessary to compensate for the load handled. In an electric forklift the battery may serve also as a counterweight. Most important, the lift-truck includes a mast, which is the vertical assembly responsible for raising or lowering a load. A fork lift mast is made up of interlocking rails necessary to provide lateral stability. These rails or guideway structures are guided by rollers or bushings.

Depending on the application, typically some configurations are possible:

- single stage or "free lift" movement: the height of the forks can be raised before the mast extension;
- 2 stages (duplex). The mast has two sections, one outer that doesn't move (fixed mast structure) and one inner (movable mast structure) that raises and elevates the carriage and forks;
- 3 stages (triplex). It consists of three sections (one outer, fixed and two inner rails, movable). The two inner sections raise from outside to inside as the mast raises.

The mast is hydraulically operated and consists of cylinders and interlocking rails for lifting and lowering operations. Further, forks are provided, which are the L-shaped members that engage the load. The rear vertical portions of the forks are attached to a carriage and the front horizontal portions are inserted into or under the load, usually a pallet. Finally, a cabin with a seat for the operator is provided with pedals and switches for controlling the whole machine functions.

Usually the lift of the loads is performed by means of a hydraulic actuator. A hydraulic electro-pump supplies pressurized fluid (oil) to an hydraulic circuit (pipes, valves, distributors, actuators) to compose a system which also lifts the load by means of hydraulic cylinder. However, the efficiency of such hydraulic system is low. According to the hydraulic solution an estimate of the efficiency is related to the efficiency of the following components:

Electro pump motor: 80%, Hydraulic pump: 85%, Hydraulic valve: 90%, Hoses: 95%, Hydraulic piston: 90%.

This gives a total efficiency of $\eta=0.8\times0.85\times0.9\times0.95\times0.9=0.52$ corresponding to 52%.

BRIEF SUMMARY OF THE INVENTION

The problem underlying the present invention in view of the prior art is to provide a more energetically efficient lifting system.

The above-mentioned problem is solved by the lifter according to claim 1. According to a first aspect of the invention, the lifter, according to claim 1, comprises (FIGS. 6 and 7):

- a fixed mast structure;
- a movable mast structure movable relative to the fixed mast structure;
- at least one transmission means, such as a chain or positive drive belt or cog belt or rack; and
- a load carrier, in particular a fork load carrier, being connected to the at least one transmission means and configured to carry a load;
- wherein the at least one transmission means is movably connected to the movable mast structure while being configured to move along a close loop path, the closed loop path being stationary relative to the movable mast structure.

This has the advantage that a lifting of a load can be performed in two different ways. The first is a motion of the transmission means or transmission means system to which the load carrier is connected. By moving the transmission means, for example by turning if around one or more driving pinions and one or more guiding pinions, the load can be lifted. (FIGS. 6 and 7)

Another lifting of the load can be performed by lifting the movable mast structure relative to the fixed mast structure. In particular, the lifter can be configured to couple the two lifting motions. For example the two lifting motions can be performed one after the other. This implementation with the transmission means being connected to the movable mast structure but not to the fixed mast structure is called, in the first stage movement, "free-lift".

The lifter according to the invention does not involve any hydraulic system, and, hence, avoids the low efficiency typical of such hydraulic system.

According to a development of the lifter according to the invention, the lifter may comprise means for driving the at least one transmission means. This is one particularly convenient implementation for lifting the load by driving and, hence, moving the at least one transmission means. (FIG. 1)

According to a further development, the lifter may be configured to lift the load in a first stage by moving the transmission means along the loop path while lifting the load carrier connected to the at least one transmission means, and the lifter may be configured to lift the load in a second stage by lifting the movable mast structure. (FIG. 6)

According to another development of the lifter, the movable mast structure may be stationary during the first stage, and the at least one transmission means may be stationary along the loop path during the second stage. According to this implementation, the lifting process is divided into two distinct movements. First, the load carrier is lifted by driving the transmission means and keeping the movable mast structure stationary, and second, when the lifting motion of the transmission means has reached a certain limit, the load carrier is lifted further by lifting the mobile mast structure relative to the fixed mast structure. (FIG. 6)

According to a further development the movable mast structure comprises a retainer for stopping the relative motion between the load carrier and the movable mast structure at the end of the first stage. This is an easy implementation for separating the two lifting stages.

According to another development, the lifter may further comprise at least one driving pinion for driving the at least one transmission means, the driving pinion being attached to the fixed mast structure. According to this development, for example the shaft of the driving pinion may be supported by the fixed mast structure for exerting a force on the at least one transmission means. In particular in combination with one or more retainer rollers, this provides for an effective lifting mechanism. (FIG. 6)

According to a further development, the lifter may further comprise one or more retainer rollers for providing an engaging connection between the at least one driving pinion and the at least one transmission means. By using one or more retainer rollers the interaction of the driving pinion with the at least one transmission means can be secured and this allows the power transmission.

The above-mentioned problem is also solved by the lifter according to claim 6. According to a second aspect, the invention provides a lifter, comprising: (FIGS. 3 and 4)

a fixed mast structure;

a movable mast structure that is movable relative to the fixed mast structure;

at least one transmission means, wherein one end of the at least one transmission means is attached to the fixed mast structure, and wherein the at least one transmission means is movably connected to the movable mast structure; and a load carrier, in particular a fork load carrier, being connected to the at least one transmission means and configured to carry a load.

This implementation of a lifter according to the invention is particularly useful for heavy load applications as a powerful motor may be used for driving the movable mast. The transmission means moves in response to the movement of the movable mast structure.

According to a development the lifter may further comprise means for driving the movable mast structure. In this implementation, the movable mast is driven, and not the transmission means as in the first aspect of the invention. While lifting the movable mast structure, also the at least one transmission means that is movably connected thereto is moved, thereby lifting the load carrier. In particular, the at least one transmission means may be connected to the movable mast structure via at least one guiding pinion.

According to a further development, the lifter may be configured to lift the load by simultaneously moving the movable mast structure and the at least one transmission means.

According to another development the lifter, according to the first and second aspect, may further comprise at least one rack, in particular a toothed rack, rigidly connected to the movable mast structure and at least one rack pinion engaging the at least one rack and for driving the at least one rack. In particular for the second aspect this provides for an easy provision of an interaction of the movable mast structure with the means for driving it (FIGS. 3 and 4).

According to a further development the lifter may comprise at least one guiding pinion, wherein the at least one guiding pinion is attached to the movable mast structure and is configured to guide the at least one transmission means.

According to another development of the first aspect and its developments, the lifter may comprise an additional movable mast structure and an additional transmission means system for providing a connection between the additional movable mast structure and the fixed mast structure, in particular configured to thereby implement a third lifting stage. (FIG. 8)

According to a further development the lifter further comprises an electric motor for providing power for lifting the load carrier during a lifting phase, in particular for driving the at least one rack pinion or for driving the at least one driving pinion, more particularly, wherein the at least one transmission means is driven by the electric motor via a shaft and the at least one driving pinion being connected to the shaft.

According to another development, the electric motor may be configured to generate electric power under specific working conditions: during lowering phase the electric motor works in re generative mode (as generator) and provides energy to charge the battery of the lifter, or wherein the electric motor is connected to an electro-brake. The control brakes the moving part assembly and, in case, the load, too.

According to a further development, the lifter may comprise an epicycloidal gearbox connected to the electric motor, wherein an external ring gear of the gearbox engages a rack rigidly connected to the fixed part of the lifting structure (FIG. 12), and wherein at least one planetary gear of the gearbox is connected to a shaft with at least one driving pinion attached thereto, the at least one driving pinion engaging with the transmission means system, in particular, wherein the torques generated by the external ring gear and the at least one planetary gear are respectively calculated to provide a lifting of the load carrier in a first stage, in free lift movement (FIG. 10, section A-A), and a lifting of the load carrier and the movable mast structure together in a second stage (FIG. 11, section B-B). In this configuration and during this second stage movement, both electro motor M with epicyciclodal gearbox reduction system and movable mast structure move together.

The invention also provides a lift-truck comprising a lifter according to the invention or one of its developments, in particular comprising a further electric motor or a combustion motor for driving one or more wheels of the lift-truck.

According to a third aspect, the invention provides a lifter having: (FIGS. 1 and 2)

a fixed mast structure;

at least one transmission means; and a load carrier, in particular a fork load carrier, being connected to the at least one transmission means and configured to carry a load;

wherein the at least one transmission means is movably connected to the fixed mast structure while being configured to move along a closed loop path, the closed loop path being stationary relative to the fixed mast structure.

Developments of the third aspect, for example the driving of the transmission means, may be implemented as described in connection with the first aspect of the invention and the respective developments.

Further features and advantages of the present invention will be described in the following with reference to the figures, which illustrate only examples of embodiments of the present invention. The illustrated and described features may be suitably combined with each other, in particular with the features of the inventive electric lifter and its developments.

According to the invention as described above, the at least one transmission means can be at least one positive drive belt or at least one cog belt or at least one chain or at least one rack. The following embodiments include at least one transmission means chain for the at least one transmission means, however, just as an example.

DETAILED DESCRIPTION OF THE INVENTION

Figure 1:
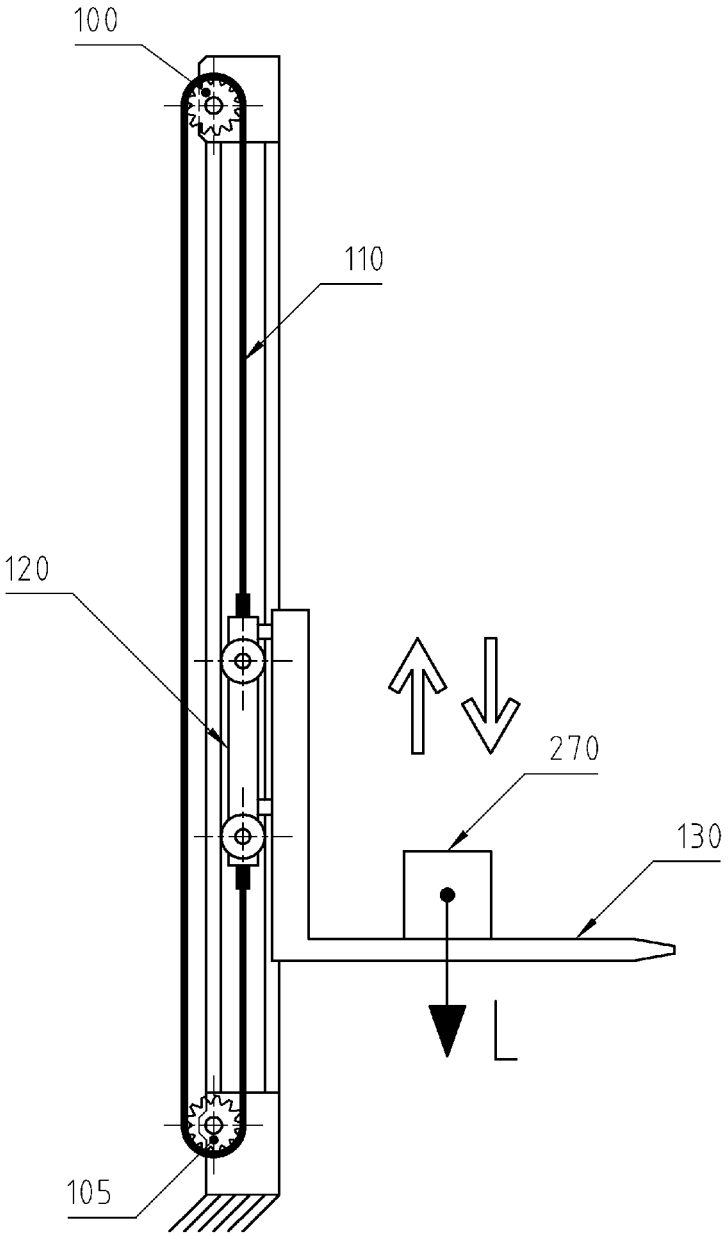
FIGS. 1 and 2 illustrate a first embodiment of the invention, "free lift" configuration in side and front view.
Figure 2:
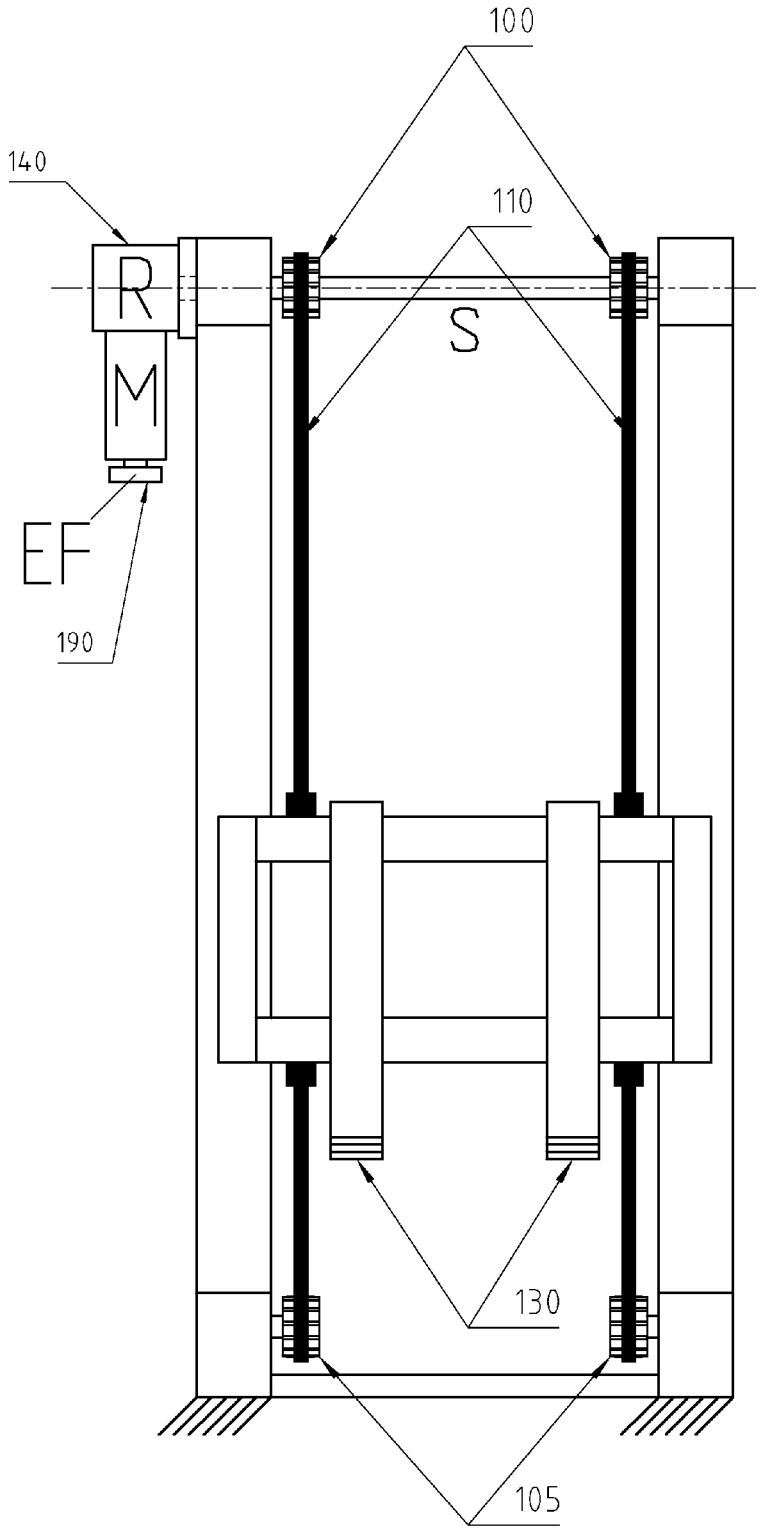

In the drawings the reference numbers denote the following:

100 driving pinion/driving chain pinion
105 guiding pinion/guiding chain pinion
110 transmission means (chain or positive drive belt or cog belt or rack)
120 forks carriage
130 forks
140 electric motor with gearbox
150 fixed mast structure
160 movable mast structure
165 rack pinion
170 rack
180 retaining roll
190 electro brake
200 stop retainer
210 transmission means hook/chain hook
215 epicycloidal reduction gearbox
220 pinion of the epicycloidal gearbox connected to the electric motor
230 planet gear of the epicycloidal gearbox directly connected to the driving pinion or through a shaft and an additional part 245
240 ring gear of the epicycloidal gearbox connected to the rack or to the rack pinion
245 driving pinion/chain pinion connected to the chain
250 plain washer
260 forks carriage connection
270 load The most simple embodiment of the invention is described in FIGS. 1 and 2, a typical "free lift" configuration, in which for example an electric motor M, with an electro brake EF and a gearbox R, by means of a shaft S and one or two driving pinions 100, drives one or more transmission means a drive member, (namely a chain or positive drive belt or cog belt or rack or similar) 110 which lift the load 270 positioned on the forks 130. In particular one of the pinions is implemented as "drive" 100 and the other one as a guiding pinion 105. The transmission means is moving in a loop path around the guiding pinions with the fork carriage being connected to each end of the transmission means 110.

Figure 3:
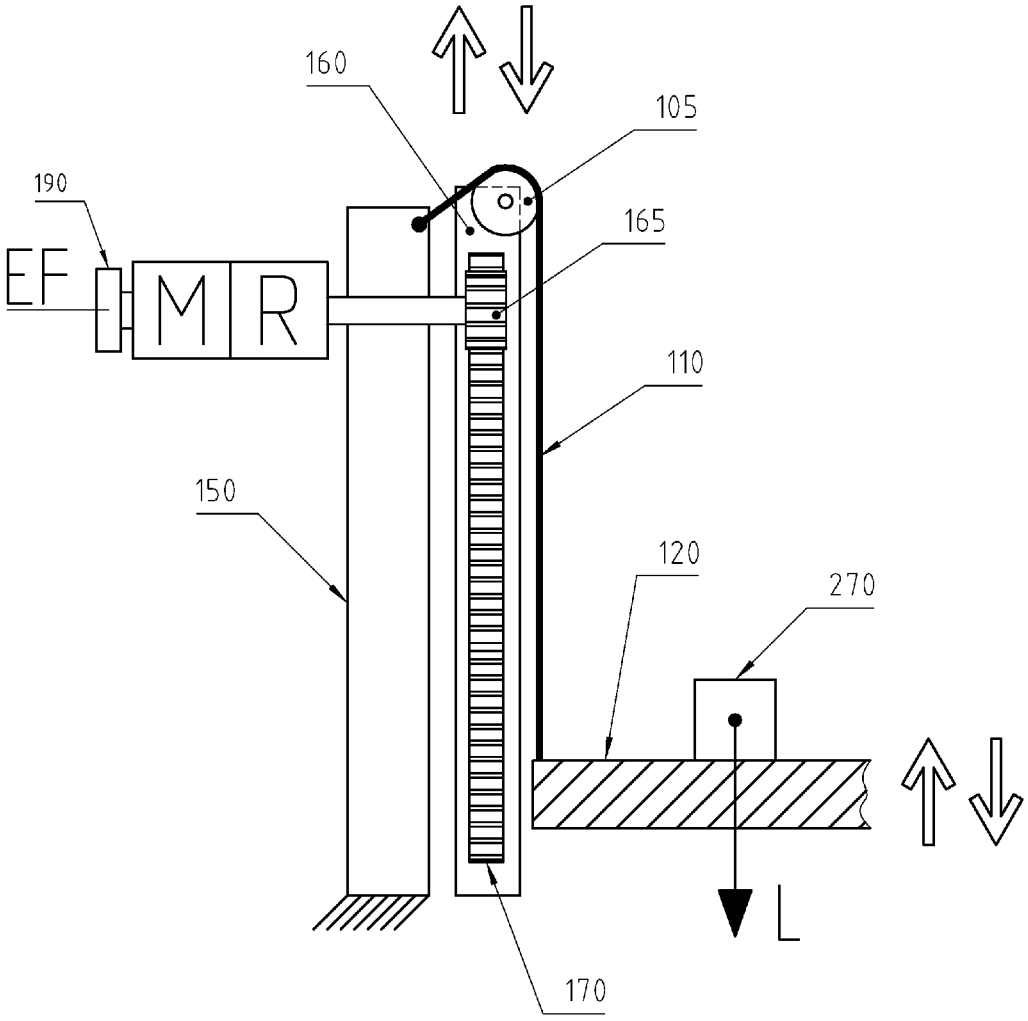
FIG. 3 illustrates a second embodiment of the invention, side view.

FIG. 3 shows the operating principle of a mast without "free lift" option, where the forks maximum height is approximately the double of the fixed mast structure (or column) height. With this solution, when the load L is lifted, the mobile column (the movable mast structure) 160 is lifted as well, thus increasing the height of the whole lifting system. The system works with an electric motor with a gearbox which, by means of a rack pinion, drives a rack that lifts the mobile column 160. The rack is rigidly connected to the mobile column 160.

Figure 4:
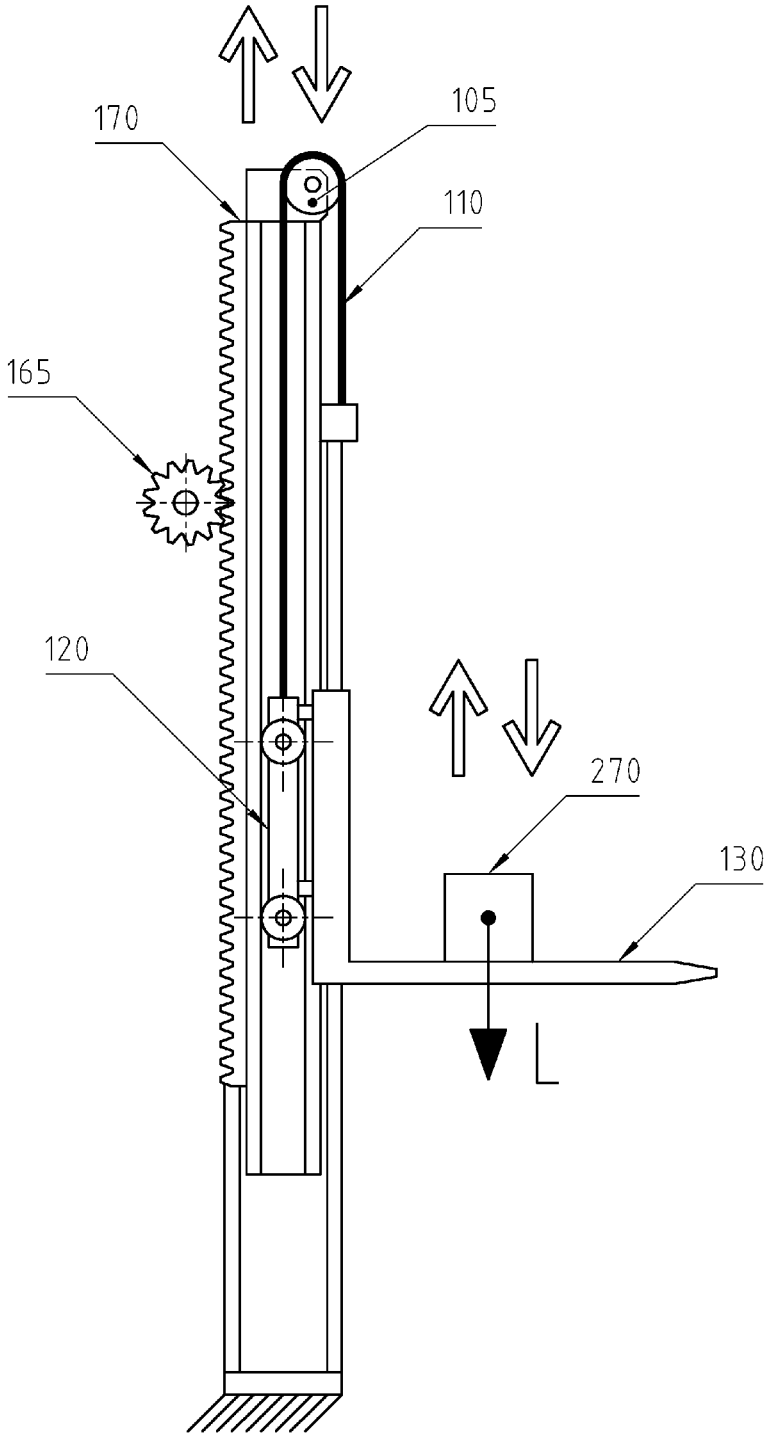
FIGS. 4 and 5 illustrate a third embodiment of the invention, two stages configuration (duplex), side and rear view.
Figure 5:
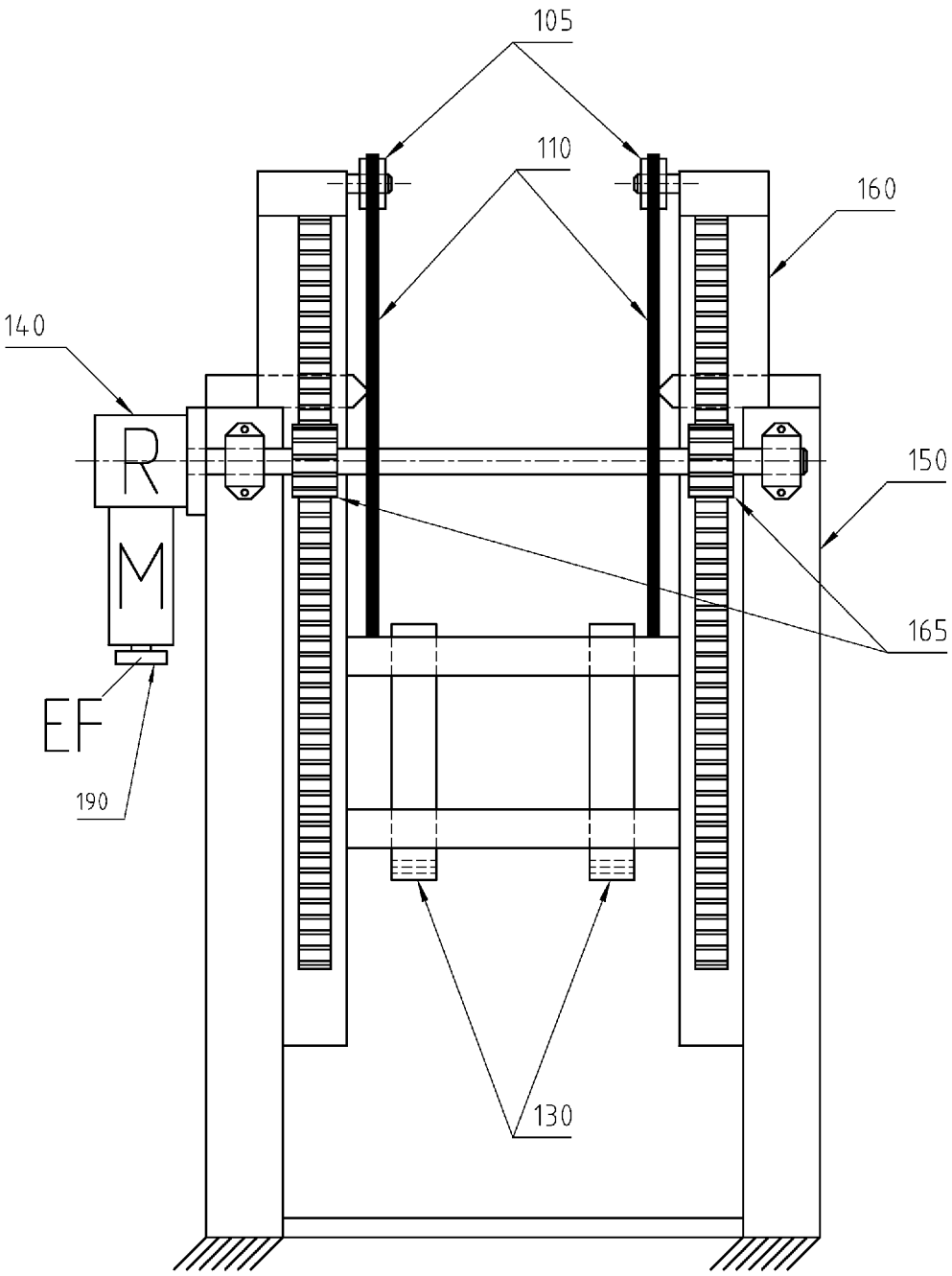

FIGS. 4 and 5 provide for a different implementation of the same concept, in a 2 stages configuration (duplex), respectively in side and rear view.

Figure 6:
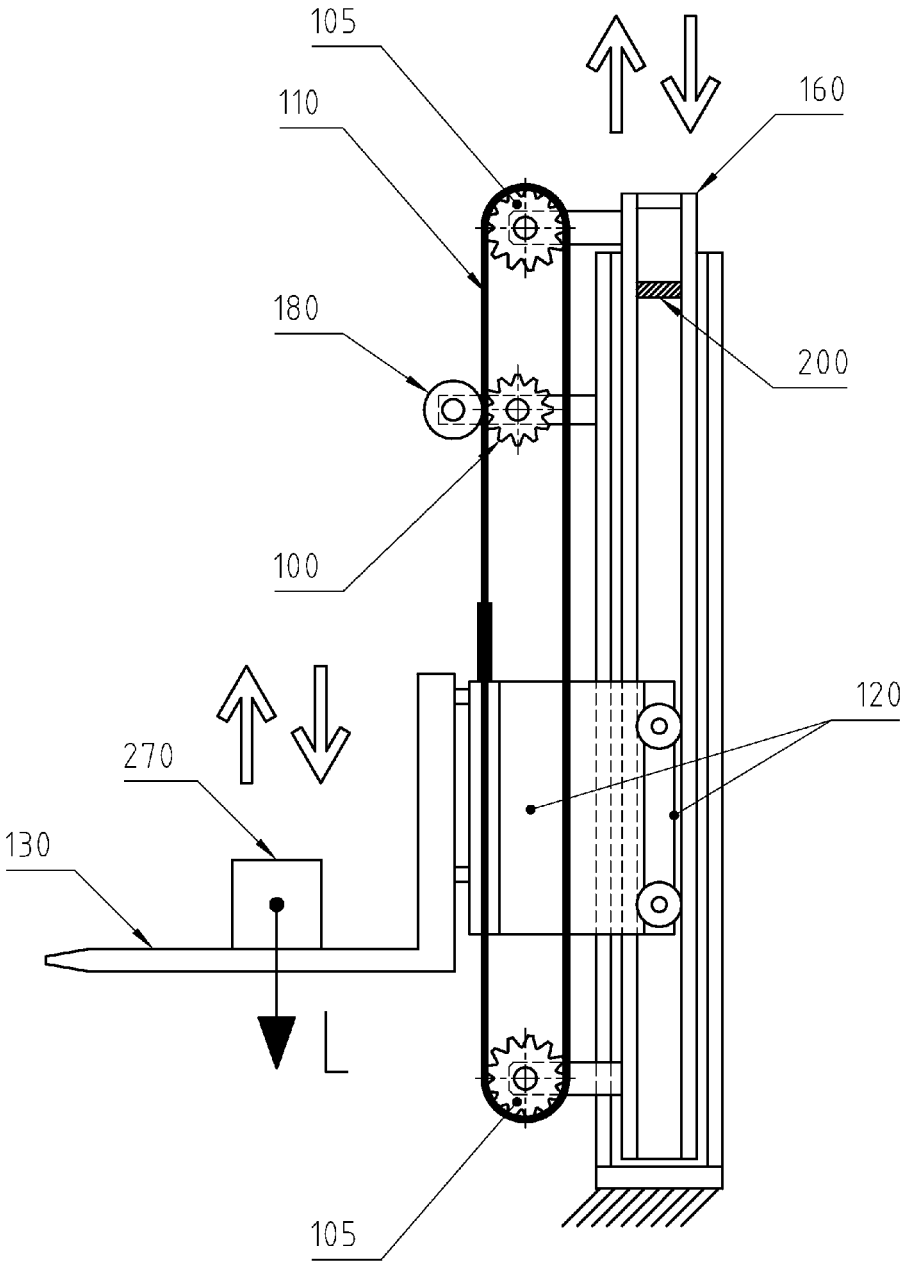
FIGS. 6 and 7 illustrate a fourth embodiment of the invention, two stages configuration (duplex) with free lift, side and front view.
Figure 7:
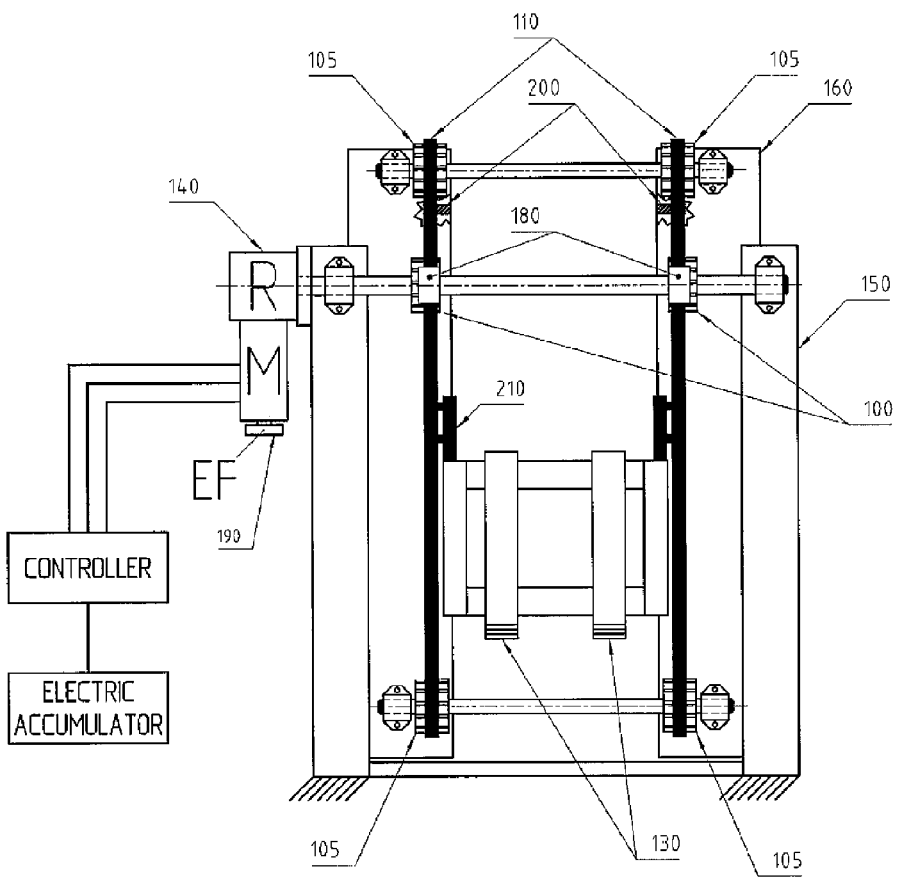

FIGS. 6 and 7 show the solution of a lifting system with "free lift" as first act, 2 stages configuration, side and front view, in the first lifting stage, according to free lift movement, there are not relative movements between fixed and movable mast structures; the advantage is that the overall height of the lifting structure does not increase. When the forks carriage 120 hits the stop retainer 200 and stops, the transmission means 110 will lift both the forks carriage 120 and the mobile column 160, at the same speed. This is the second lifting stage, during which the load L is lifted up to a height which is almost double than the fixed column.

Figure 8:
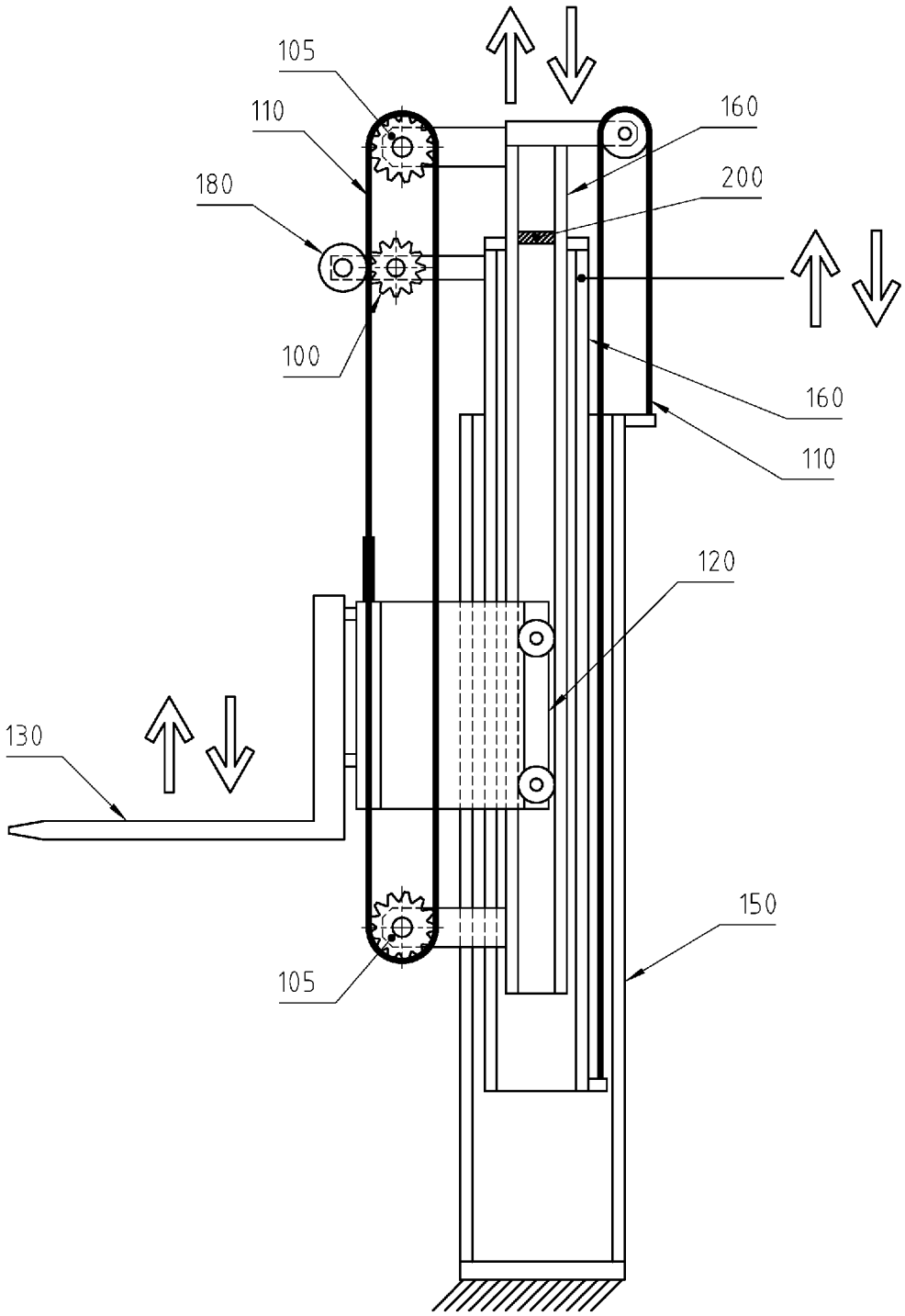
FIG. 8 illustrates a fifth embodiment of the invention, three stages configuration (triplex) with free lift, side view.

FIG. 8 shows the solution of a lifting system with "free lift" as first act, 3 stages configuration, side view. The lifter comprises an additional movable mast structure 160 and an additional transmission means, if compared to two stages configuration.

Figure 13:
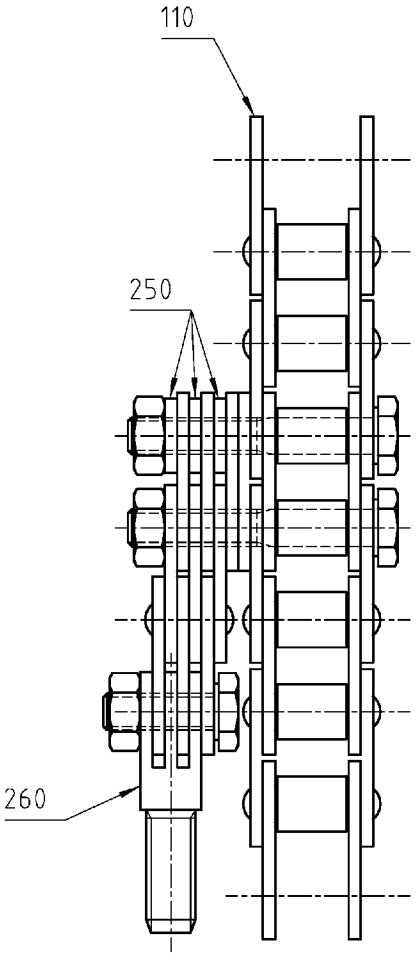
FIG. 13 illustrates a possible flexible connection between the transmission means and the forks carriage.

The clamping system of the forks carriage 120 and the transmission means 110 will be accurately studied to allow the transition through the driving pinion 100 and the retaining roll or rolls 180. FIG. 13 shows an example of a possible implementation, without limitations and restrictions.

FIGS. 9, 10, 11 and 12 show another possible embodiment of the invention. The electric motor M and, if necessary, the gearbox R drives an epicycloidal gearbox (refer to FIG. 9) which is designed to generate different output torque in order to create a sequence of the movements; during the lifting phase, the forks carriage 120 moves first and then the mobile column 160 moves; following the same principle, during the lowering phase, the mobile column 160 will lower first, and then the forks carriage 120.

In particular, the invention provides the following embodiments:

1.) Fully electric lifter system that, by means of an electric motor and a transmission means (ref. FIG. 6), lifts loads wherein, with the controlled movement of the transmission means 110, it carries out both the function of "free lift" (first step) and the function to lift completely the mobile column 160 with the correct lifting sequence (second step) in this two stages example; in case of a non "free lift" implementation, with only an half turn of the transmission means 110 (see FIGS. 4 and 5), it carries out the function to lift completely the forks 130, lifting at the same time completely the mobile column 160 up to the top by means of a rack fixed to the mobile column.

Figure 9:
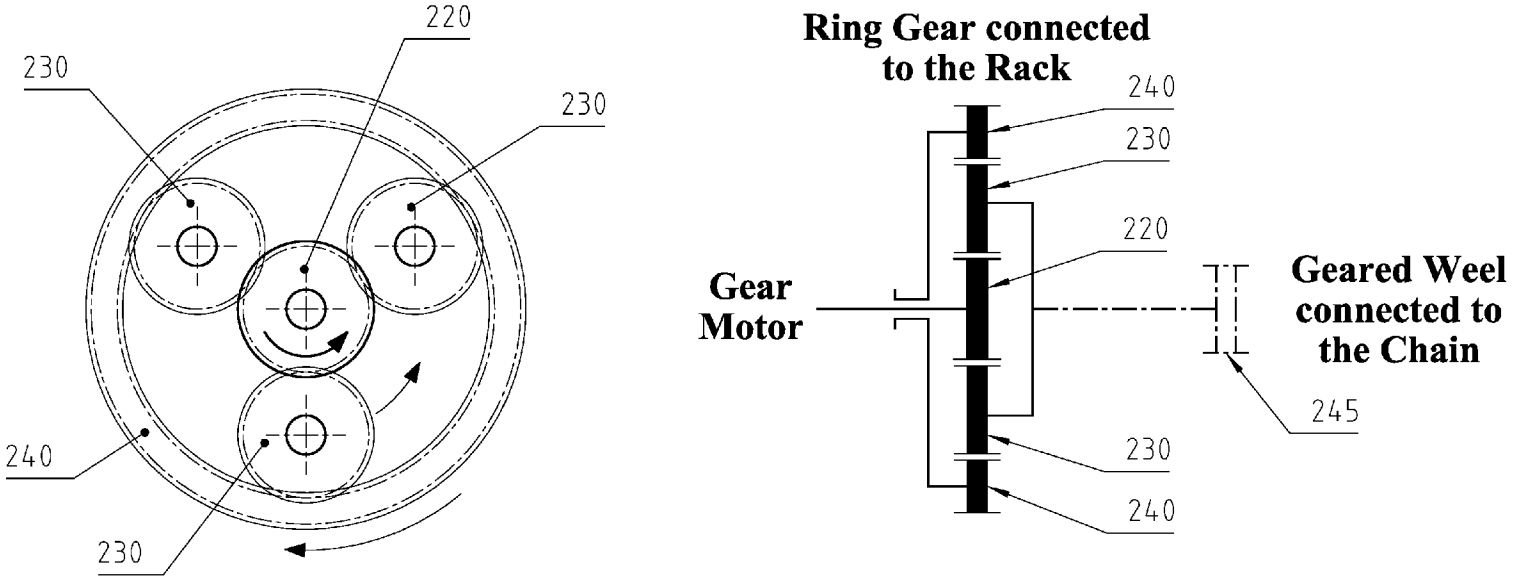
FIGS. 9-12 illustrates a sixth embodiment of the invention.
Figure 10:
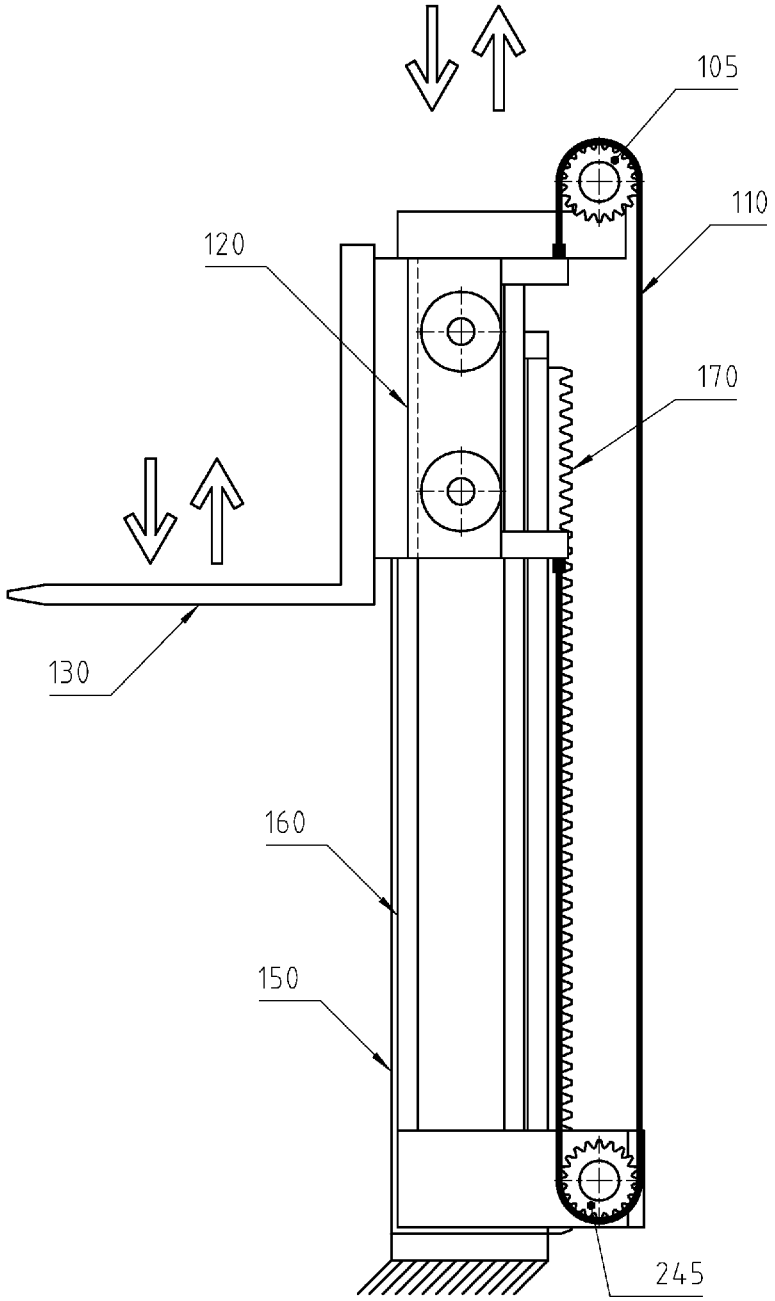
Figure 11:
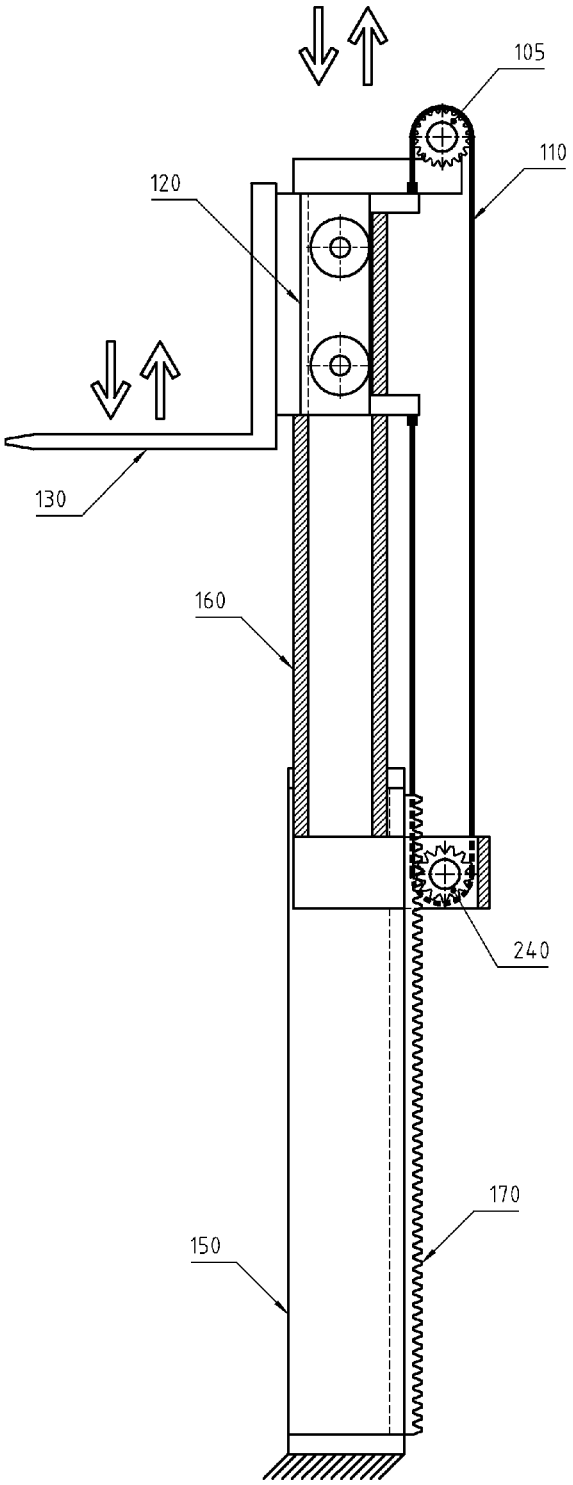
Figure 12:
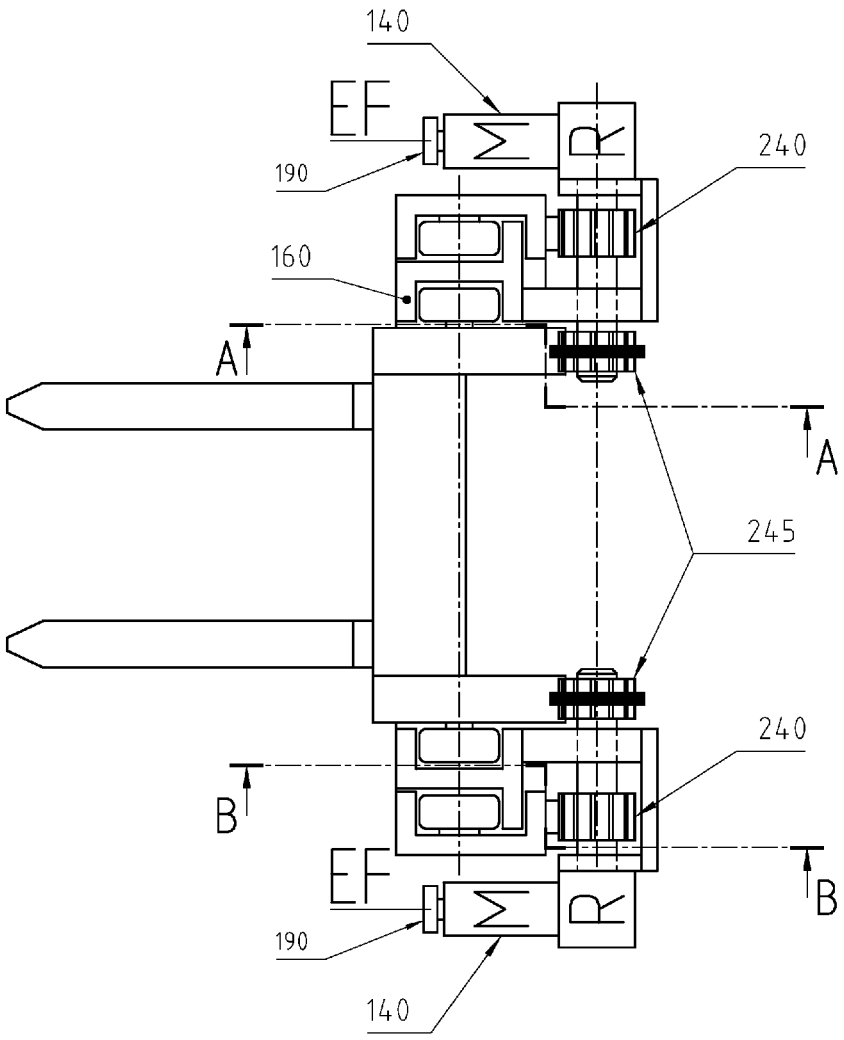

2.) Fully electric lifter system made by an electric motor connected to an epicycloidal gearbox (ref. FIG. 9), wherein an external ring gear 240 of the gearbox engages a rack rigidly connected to the fixed part of the lifting structure (ref. FIG. 12) and wherein at least one planetary gear of the gearbox is connected to a shaft with at least one driving pinion 245 attached thereto, the at least one driving pinion engaging with the transmission means 110, in particular, wherein the torques generated by the external ring gear and the at least one planetary gear are respectively calculated to provide a lifting of the load carrier 120 in a first stage, in free movement, and a lifting of the load carrier and the movable mast structure 160 together in a second stage.

3.) A Lifter as defined in embodiment 1 that has one or more retaining rolls, as shown in FIGS. 6 and 7, item 180, that ensure a strong and reliable connection between the driving pinion 100 and the lifting transmission means 110.

4.) A Lifter as defined in embodiments 1 and 3 in which a single turn of the transmission means 110 allows first the lifting of the forks carriage 120 implementing the concept of "free lift" and then the lifting, at the same time, of the forks carriage 120 and the mobile column 160.

5.) A Lifter as defined in embodiments 1, 2, 3 and 4 where the lowering of forks carriage, mobile mast structure and accessories allows the energy recovery of the potential energy accumulated during the lifting actions of forks carriage, mobile mast structure and accessories. In the case of lowering weights, loads and goods in general, also their own potential energy will be converted to electric energy.

6.) A Lifter as defined in embodiments 1, 2, 3 and 4 wherein it is implemented a mobile flexible connection between the transmission means and the forks carriage (FIG. 13) that allows the transition through the driving pinions 100 and the retaining rolls 180.

7.) A Lifter as defined in embodiments 1, 2, 3, 4, 5 and 6 that, by means of an additional transmission means, implements a lifting feature based on the concept of triplex column (FIG. 8).

An important feature has to be underlined: during the lifting phase the electric motor provides energy to the mobile part of the lifting structure and to the load which is accumulated as potential energy Wp:

$$Wp=L\times h+L1\times h1,$$

where

L is the load

L1 is a part of the lifting structure h is the load lifting height h1 is the lifting height of a part of lifting structure.

During the lowering phase this energy is given back to the electric motor that, in this operating condition, works like a generator and regenerates energy back to the mains or, for example, to the battery.

According to the electric solution with an electric motor and a gearbox an estimate of the efficiency η of the following components can be given: Electric motor: 80%, Reduction gearbox: 95%. Therefore, the total efficiency is about η: 0.8×0.95=76%.

The electric motor M is usually connected to an electronic power converter that regulates the power to the motor during the lifting phase (driving) and regulates the power of the generator back to the mains or to the battery during the lowering phase (regenerating).

Having described the preferred embodiments, it will become apparent that various modifications can be made, without departing from the scope of the invention as defined in the accompanying claims.

The invention claimed is:

1. A lifter comprising:

a fixed mast structure;

a movable mast structure that is movable relative to the fixed mast structure;

at least one transmission assembly, the transmission assembly comprising a motor and at least one drive member; and a load carrier, connected to the at least one drive member and structured to carry a load, wherein the at least one drive member is movably connected to the movable mast structure and is structured to move along a respective closed loop path, wherein the at least one drive member is structured to transmit a lifting force from the motor to the load carrier, and wherein the lifter is structured to lift the load carrier in a first stage by moving the at least one drive member along the closed loop path while lifting the load carrier connected to the at least one drive member, and wherein the lifter is structured to lift the load carrier in a second stage by the at least one drive member transmitting a lifting force through the load carrier to the movable mast structure to thereby cause the load carrier to lift the moveable mast structure.

2. The lifter according to claim 1, wherein the movable mast structure is stationary during the first stage, and wherein the at least one drive member is stationary along the closed loop path during the second stage.

3. The lifter according to claim 2, wherein the movable mast structure comprises a stop retainer that is structured to stop the relative motion between the load carrier and the movable mast structure at the end of the first stage.

4. The lifter according to claim 1, further comprising at least one driving pinion for driving the at least one drive member, the driving pinion being attached to the fixed mast structure.

5. The lifter according to claim 4, further comprising one or more retaining rolls structured to provide an engaging connection between the at least one driving pinion and the at least one drive member.

6. Lifter according to claim 1, further comprising at least one rack, in particular a toothed rack, rigidly connected to the movable mast structure and at least one rack pinion engaging the at least one rack and for driving the at least one rack.

7. The lifter according to claim 1, further comprising at least one guiding pinion, wherein the at least one guiding pinion is attached to the movable mast structure and is structured to guide the at least one drive member.

8. The lifter according to claim 1, further comprising an additional movable mast structure and an additional drive member for providing a connection between the additional movable mast structure and the fixed mast structure and structured to implement a third lifting stage.

9. The lifter according to claim 1, wherein the motor is an electric motor configured to provide power to the at least one drive member for lifting the load carrier during a lifting phase.

10. The lifter according to claim 9, wherein the electric motor is configured and managed to generate electric power during a lowering phase.

11. The lifter according to claim 10, wherein the electric motor is managed by a controller in order to charge an electric accumulator or wherein the electric motor is connected to an electro-brake.

12. The lifter according to claim 9, comprising an epicycloidal gearbox connected to the electric motor, wherein an external ring gear of the epicycloidal gearbox engages a rack rigidly connected to the fixed part of the lifter, and wherein at least one planetary gear of the epicycloidal gearbox is connected to a shaft with at least one driving pinion attached thereto, the at least one driving pinion engaging with wherein torque generated by the external ring gear and the at least one planetary gear are calculated to provide a lifting of the load carrier in a first stage and a lifting of the load carrier and the movable mast structure in a second stage.

13. A lift-truck comprising the lifter according to claim 1.

14. The lifter according to claim 1, wherein the load carrier is a fork load carrier.

15. The lifter according to claim 1, wherein the at least one drive member comprises at least one chain or rack.

* * * * *